US005709460A

United States Patent [19]

Lester

[11] Patent Number: 5,709,460

[45] Date of Patent: Jan. 20, 1998

[54] INDIRECT FLUORESCENT LIGHTING FIXTURE

[75] Inventor: Robert W. Lester, Hillsboro Beach, Fla.

[73] Assignee: CoveLight Corporation, Boca Raton, Fla.

[21] Appl. No.: 767,914

[22] Filed: Dec. 17, 1996

[51] Int. Cl.[6] ..... F21S 1/02

[52] U.S. Cl. ..... 362/147; 362/365; 362/346; 362/225; 362/243; 362/351

[58] Field of Search ..... 362/260, 147, 362/145, 225, 217, 243, 240, 247, 249, 365, 364, 346, 366, 351

[56] References Cited

U.S. PATENT DOCUMENTS

| | | | |
|---|---|---|---|
| D. 362,315 | 9/1995 | Herst et al. . | |
| 4,388,675 | 6/1983 | Lewin . | |
| 4,390,930 | 6/1983 | Herst et al. . | |
| 4,660,131 | 4/1987 | Herst et al. . | |
| 4,748,543 | 5/1988 | Swarens | 362/365 |
| 4,760,505 | 7/1988 | Cole, Jr. . | |
| 5,146,393 | 9/1992 | Crane | 362/365 |
| 5,160,193 | 11/1992 | Fabbri et al. | 362/147 |
| 5,199,782 | 4/1993 | Johnson et al. | 362/365 |

*Primary Examiner*—Thomas M. Sember
*Attorney, Agent, or Firm*—Collard & Roe, P.C.

[57] ABSTRACT

An indirect fluorescent lighting fixture for recessed mounting in a grid-type ceiling, comprising an elongated dome having an arcuate cross section and two elongated coves, each capable of holding at least one fluorescent light bulb. Each cove is mounted along a longitudinal edge of the dome. The inner face of the dome points in the downward direction and is capable of reflecting light. Each cove has an outer wall, a base and an inner wall. The outer wall of each cove is attached to an elongated edge of the dome. The base of each cove extends toward the center of the dome. The dome overlaps the opening in the ceiling grid so that the coves are hidden from view behind the ceiling panels on either side of the opening. Light from fluorescent light bulbs mounted in the coves is directed upward to the inner face of the dome where it is reflected down into the room. When the fixture is mounted recessed in a ceiling, the light bulbs in the coves and the ends of the dome are invisible to occupants of the room.

10 Claims, 3 Drawing Sheets

INDIRECT FLUORESCENT LIGHTING FIXTURE

BACKGROUND OF THE INVENTION

1. Field of the Invention

This invention relates to an indirect fluorescent lighting fixture. In particular, the invention relates to a fixture whereby the fluorescent light bulbs are hidden in a cove on either side of the fixture, and light from each bulb radiates upward and is reflected off of a domed upper portion of the fixture.

2. The Prior Art

Fluorescent lighting fixtures are widely used to illuminate spaces. However, these fixtures have many shortcomings. For example, standard fluorescent lighting fixtures are very inefficient due to the use of a translucent plastic diffuser over the fixture, which decreases lighting efficiency. The standard diffusers reduce the amount of light emitted into a room by approximately 50%, depending on the type of plastic that is used for the diffuser. Louvers are sometimes used in place of diffusers, since they decrease the amount of emitted light by only 25%. However, with louvers, the light bulbs are visible from certain angles, thus increasing glare and decreasing the lighting fixture's aesthetic appearance.

To overcome the inefficiency of direct fluorescent lighting, indirect lighting fixtures have been used. With the known fixtures, light from a light source is not visible from outside the light source, but emanates into the room from a reflection off of another surface. In this way, the light is less harsh and is better dispersed into the room, with less shadow than direct lighting. Indirect lighting also reduces the glare that may occur with direct lighting fixtures. In addition, with indirect lighting, the light source, which is sometimes not aesthetically pleasing by itself, is hidden from view.

U.S. Pat. No. 4,388,675 discloses an indirect lighting fixture comprised of a rectangular housing having a V-shaped reflector member located beneath each bulb for directing light upward and onto the ceiling for reflection into the room.

U.S. Pat. No. 4,390,930 shows an indirect lighting fixture having a cylindrical housing and reflector means wherein the light is directed upward to illuminate a room.

U.S. Pat. No. 4,760,505 discloses an indirect lighting fixture comprised of a U-shaped housing for holding two vertically-arranged fluorescent bulbs, wherein the light from the bulbs is reflected upward and off the ceiling. All of these references rely on reflection of the light source off of the ceiling to illuminate the room.

The drawbacks of the prior art indirect lighting fixtures are that the housings themselves decrease the efficiency of the lighting by blocking some of the reflections off of the ceiling. In addition, a common, flat painted ceiling is not an efficient reflector of the indirect light.

SUMMARY OF THE INVENTION

It is therefore an object of the present invention to overcome the drawbacks of the prior art and to provide an indirect lighting fixture that maximizes the efficiency of the reflected light.

It is another object of the present invention to provide an indirect lighting fixture that is aesthetically pleasing and that hides the direct light source.

It is yet another object of the present invention to provide an indirect lighting fixture that is lightweight and easy and inexpensive to manufacture, using aluminum extrusions.

These and other objects of the present invention are accomplished by an indirect lighting fixture comprising an elongated dome for holding a plurality of fluorescent light bulbs, wherein the dome has an arcuate cross section and is adapted for recessed mounting in the ceiling of a room. Two longitudinally extending u-shaped channel-like coves are mounted, one on each side of the dome, for holding the fluorescent bulbs. The fixture is mounted in place of ceiling panels in a grid-type ceiling, so that the coves and the edges of the dome are hidden behind the ceiling panels on either side of the fixture, and more of the internal surface of the dome is visible, and the dome has the effect of appearing endless from any direction of view.

The dome itself has an arcuate cross-section and an inner and outer face. The dome preferably has an angle of curvature of approximately 45 degrees. This angle keeps the amount of glare from the reflected light to a minimum. The inner face is aimed downward toward the floor. The inner face of the dome is preferably coated with a non-glare coating or paint such as semi-matte white enamel for reflecting the light emanating from the light bulbs in the coves down into the room in an aesthetically pleasing manner without harsh glare. The dome is formed to optically correct contours to provide precise light distributions with maximum efficiency and effective glare control.

End plates having dimensions equal to the cross-section of the dome are mounted on each longitudinal end of the dome to enclose the fixture. The coves are preferably equipped with grooves that allow screws to be inserted therein to mount the end plates to the fixture. The upper edge of the end plate is flanged to overlap the edge of the dome. The flange secures the dome to the rest of the lighting fixture without the use of screws or other fasteners. The flange also prevents any light from leaking out from the edge of the dome. Each end plate also has an opening to allow the wires from the light bulbs to extend therethrough.

The upper portion of the coves allows the light from the bulbs inserted therein to escape and be evenly reflected off the inner face of the dome and down into the room. Each cove is comprised of a downwardly-extending outer wall attached to the edge of the dome, a base extending inward and at an angle toward the floor, and an upwardly-extending inner wall.

Each light bulb is mounted on an aluminum strip that may be slid in to longitudinally extending grooves in the side walls of the cove to mount the light bulbs in an easy and efficient manner. The end plates of the fixture keep the aluminum strip from sliding out of the fixture, creating a covered wireway in the cove.

The lighting fixture may also have a bottom mask, which rests on the ceiling grids, usually T-rails. The fixture is then mounted on top of the bottom mask. The bottom mask covers a portion of the inner face of the dome. The bottom mask contains a large center aperture through which the light reflecting off of the inner face may pass. The aperture may be of any shape or design, but is preferably oval.

The fixture is preferably made from a lightweight, flexible, heat resistant material such as aluminum sheeting and extrusions. During use, the coves are configured so as to keep the light bulbs out of the line of sight of all occupants of the room, but are open enough to allow the maximum amount of light to emanate from the bulbs and be reflected off the inner face of the dome.

Multiple fixtures may be used together, to form a continuous row of light in a ceiling. In this embodiment, the end panels that are mounted on the ends of each dome do not cover the end of the dome but are mounted above the dome and have an arcuate shape that follows the edge of the dome. Each end panel is affixed to the coves in the same manner described above. In this way, the end piece can be bolted to a similar end piece that is attached to an adjacent light fixture.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
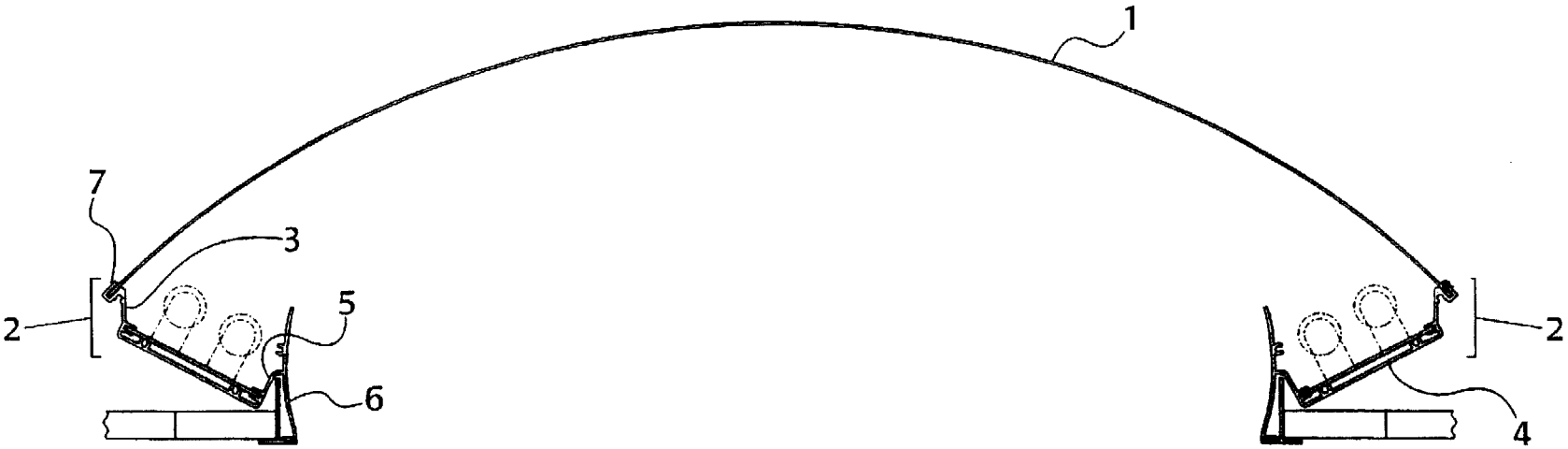
FIG. 1 is a cross-sectional view of the lighting fixture of the present invention.
Figure 2:
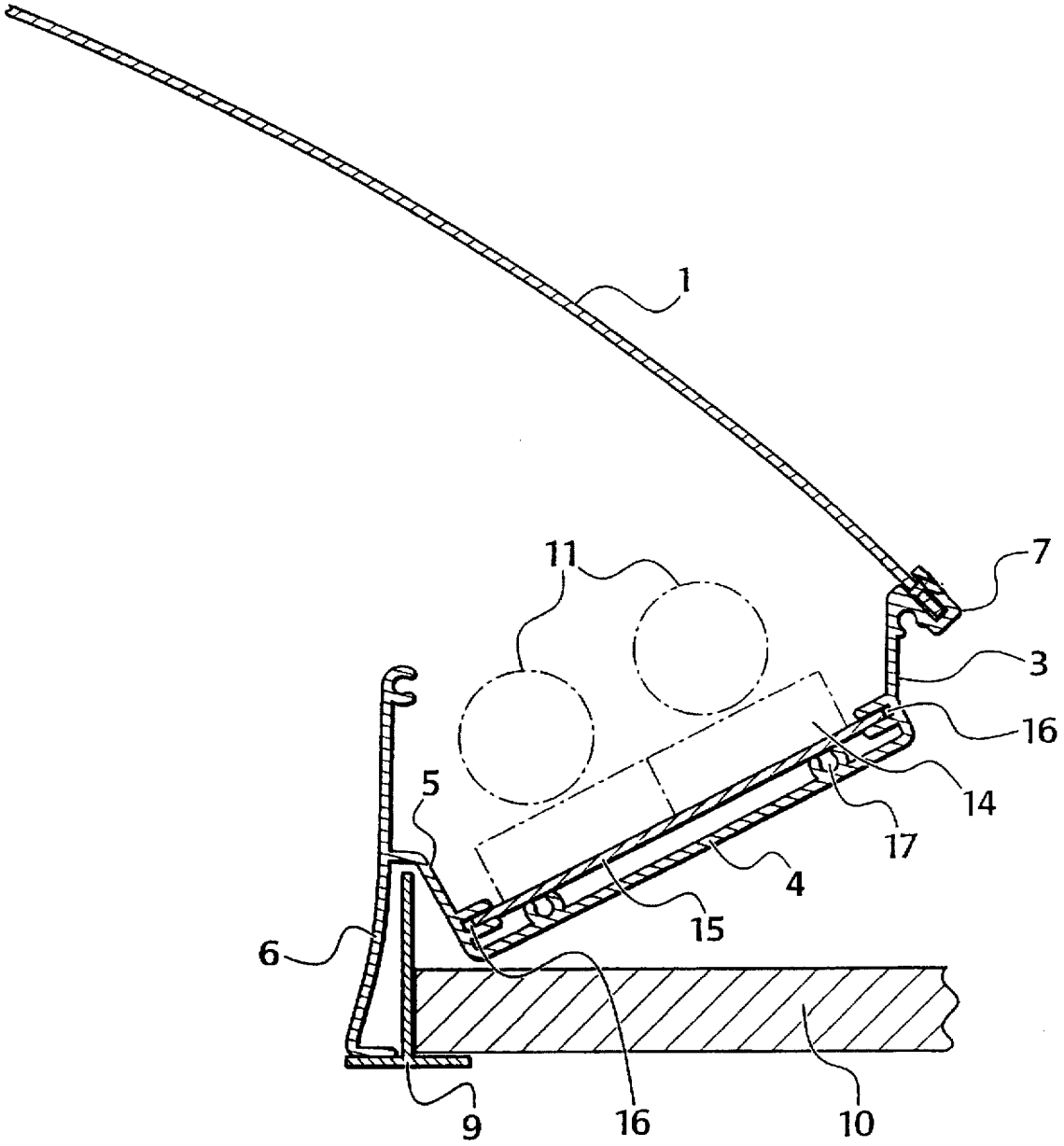
FIG. 2 is an enlarged view of the right cove of the embodiment shown in FIG. 1.

Referring now in detail to the drawings, and in particular FIGS. 1 and 2, there is shown a cross section of a lighting fixture according to the present invention, comprising a dome 1 and coves 2 running along each longitudinal edge of dome 1. Dome 1 preferably has an angle of curvature of approximately 45 degrees. Cove 2 is comprised of outer wall 3, base 4, and inner wall 5. Base 4 is angled approximately 25° below horizontal toward the floor. The angle of the cove maximizes the amount of light that is reflected off of the inner face of dome 1 and into the room.

Cove 2 is equipped with grooves 17 into which screws can be inserted for mounting of end pieces. Cove 2 also contains slot 7 on outer wall 3 for attaching each cove to dome 1. Inner wall 5 of cove 2 is integrally formed with a bracket 6, which prevents the light bulbs 11 from being seen, and attaches to a section of a ceiling grid 9 to mount the fixture. Ceiling grid 9 is attached to ceiling panel 10 on either side of dome 1. The dome overlaps the opening in the ceiling in which the fixture is mounted, so that the coves 2 and the ends of dome 1 are hidden behind ceiling panels 10.

A mounting structure 14 is located within cove 2 for mounting of a fluorescent light bulbs 11. Mounting structure 14 is attached to an aluminum strip 15, which is mounted in coves 2 by sliding it in grooves 16. Light bulbs 11 may be wired to an electrical outlet with any conventional wiring means.

Figure 3:
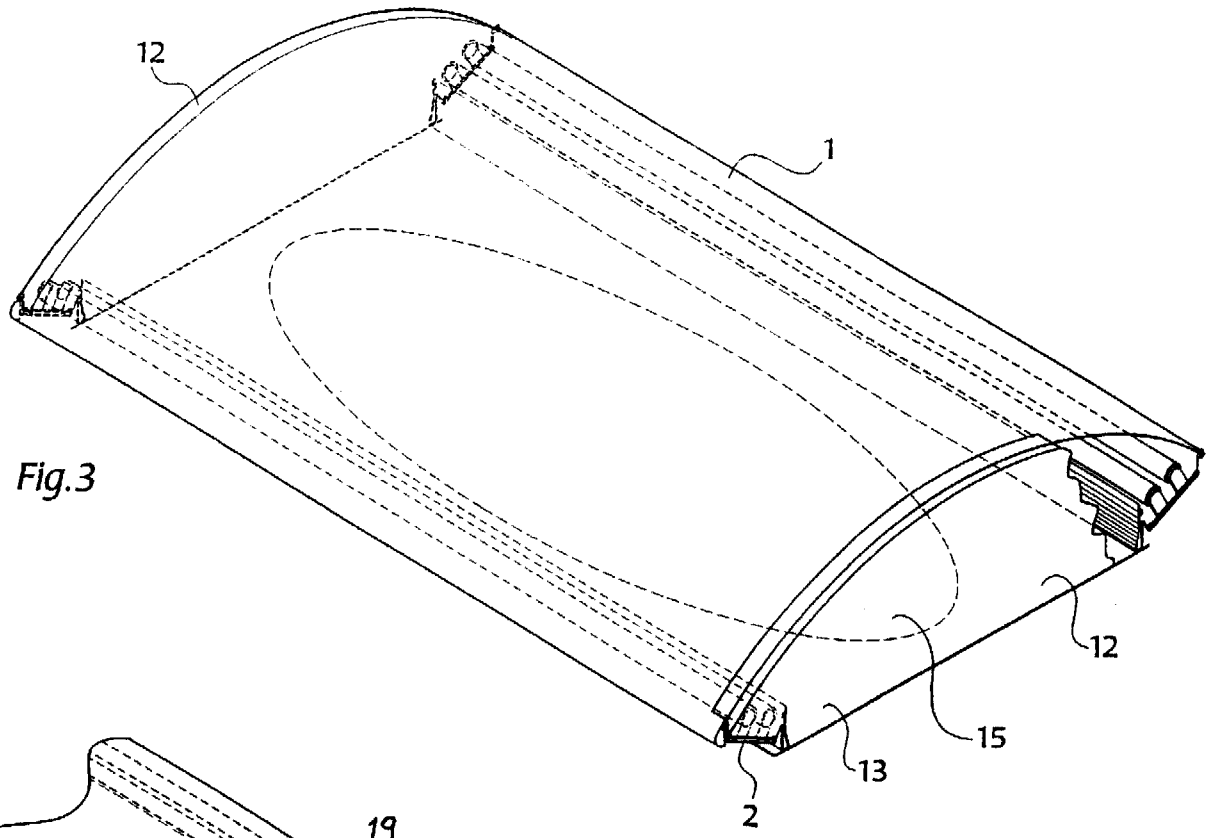
FIG. 3 is a perspective view of the light fixture with end pieces and a bottom mask attached thereto.

FIG. 3 shows the light fixture of the present invention having a bottom mask 13 and end covers 12. End covers 12 fit over the outside of dome 1 and seal off the ends of the lighting fixture, increasing its aesthetic appearance. End covers 12 are mounted to the fixture via screws that are screwed into grooves 17, which are shown in FIG. 2. End covers 12 have apertures 20 through which the wires of the light bulbs 11 may pass. Bottom mask 13 has an oval-shaped aperture 15 through which reflected light from the inner surface of dome 1 is reflected. This mask aperture may be of any shape or size, depending on the tastes of the consumer.

Figure 4:
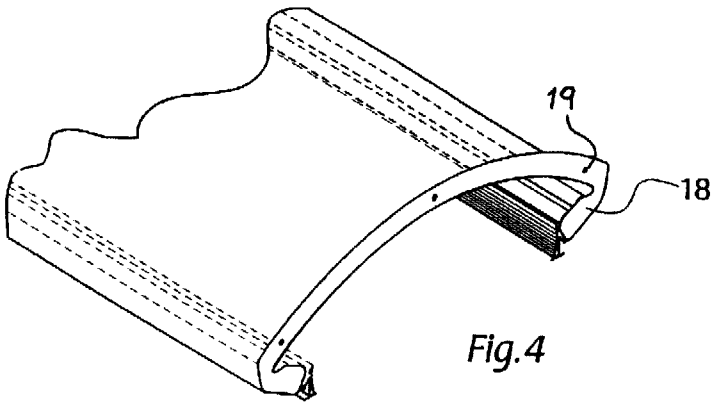
FIG. 4 is a perspective view of another embodiment of the light fixture with an alternative end piece.

An alternate embodiment of the invention is shown in FIG. 4. In this embodiment, the end plate 18, instead of covering the cross section of the dome, extends up above the edge of the dome. End plate 18 is adapted for attaching by screws to a similar end plate that is affixed to a second lighting fixture, to enable the joining of two fixtures together to form a continuous row of lighting fixtures recessed in a ceiling. End plate 18 can hold the top of dome 1 down into slots 7 of coves 2 through the use of bolts 19, which are screwed into the bottom portion of plate 18 and whose heads rest flush against the surface of dome 1.

Accordingly, while only several embodiments of the present invention have been shown and described, it is obvious that many changes and modifications may be made thereunto without departing from the spirit and scope of the invention.

What is claimed is:

1. An indirect fluorescent lighting fixture for recessed mounting in an opening of a grid-type ceiling in a room, comprising:

an elongated dome having an arcuate cross section, two longitudinal edges, two ends, and an inner face an outer face, wherein the inner face is arranged pointing in a downward direction and wherein the inner face is capable of reflecting light from the dome;

two elongated coves, each cove capable of holding at least one fluorescent light bulb and each mounted along one of the longitudinal edges of said dome, each of said coves having an outer wall, a base and an inner wall, wherein said outer wall is attached to one of said longitudinal edges of the dome, wherein said base extends toward a central area of the dome, and wherein the dome is elevated above the opening in the ceiling;

such that light from the fluorescent light bulbs mounted in the coves is directed toward the inner face of the dome and reflected off the inner face into the room, and wherein the edges of the dome overlap the opening in the ceiling so that the edges of the dome and the coves are hidden from view and create an appearance that the dome extends endlessly.

2. The lighting fixture of claim 1, further comprising a longitudinally extending bracket attached to the inner wall of each cove, wherein said bracket prevents light bulbs mounted in each of said coves from being seen and enables mounting of the fixture on a ceiling grid.

3. The lighting fixture of claim 1, wherein the base of each cove is positioned at an angle of about 25 degrees below horizontal.

4. The lighting fixture of claim 1, further comprising at least one end cover, mounted on one of the end said dome and masking a entire cross section of said dome, wherein said end cover has a flange that overlaps the end of the dome to secure the dome to the fixture and to prevent light from leaking out from the end of the dome.

5. The lighting fixture of claim 1, further comprising a bottom mask mounted on top of the opening in the ceiling grid, wherein the fixture is mounted on top of said mask, wherein said bottom mask masks the inner face of the dome, and wherein said bottom mask has an aperture through which light reflected off the inner face of the dome may pass.

6. The lighting fixture of claim 5, wherein the aperture is oval.

7. The lighting fixture of claim 1, wherein the inner face of the dome is coated with non-glare paint.

8. The lighting fixture of claim 1, wherein the dome has an angle of curvature of about 45 degrees.

9. The lighting fixture of claim 1, further comprising at least one cover having an arcuate shape and having an angle of curvature equal to the angle of curvature of the dome, wherein said end cover is mounted on one end of the dome above the dome, and wherein said end cover is capable of being mounted to a second end cover that is mounted on a second lighting fixture, to create a continuous row of lighting fixtures.

10. The lighting fixture of claim 1, further comprising a longitudinally extending groove integrally formed with each of the inner wall and the outer wall of the cove, and an aluminum strip, wherein the light bulbs are mounted on the aluminum strip and the aluminum strip is mounted in the cove by sliding the strip into the grooves, and wherein a covered wireway is created between the strip and the base of the cove to conceal the wires from the light bulbs.

* * * * *